US005224998A

United States Patent [19]

Ohmi et al.

[11] Patent Number: 5,224,998

[45] Date of Patent: Jul. 6, 1993

[54] APPARATUS FOR OXIDATION TREATMENT OF METAL

[75] Inventors: Tadahiro Ohmi, 1-17-301, Komegabukuro 2-chome, Aoba-ku, Sendai-shi, Miyagi-ken 980; Kazuhiko Sugiyama, Sendai; Fumio Nakahara, Tokyo; Satoshi Mizokami, Sendai, all of Japan

[73] Assignees: Tadahiro Ohmi, Miyagi; Sanso Kogyo Kabushiki Kaisha, Osaka, both of Japan

[21] Appl. No.: 449,846

[22] PCT Filed: Aug. 14, 1989

[86] PCT No.: PCT/JP89/00824

§ 371 Date: Nov. 28, 1989

§ 102(e) Date: Nov. 28, 1989

[87] PCT Pub. No.: WO90/02212

PCT Pub. Date: Mar. 8, 1990

[30] Foreign Application Priority Data

Aug. 17, 1988 [JP] Japan ..... 63-203102

[51] Int. Cl.[5] ..... C23C 16/00

[52] U.S. Cl. ..... 118/720; 118/715; 118/725; 118/728; 427/239; 427/237; 266/252; 266/254; 266/255; 266/258

[58] Field of Search ..... 118/715, 725, 728, 719, 118/720; 427/237, 239; 266/252, 254, 255, 258

[56] References Cited

U.S. PATENT DOCUMENTS

| | | | |
|---|---|---|---|
| 2,783,164 | 2/1957 | Hill | 427/237 |
| 2,815,299 | 12/1957 | Raymond | 427/237 |
| 3,031,338 | 4/1962 | Bourdeau | 427/237 |
| 4,138,512 | 2/1979 | Glaski | 427/237 |
| 4,293,594 | 10/1981 | Yoldas | 427/437 |
| 4,294,871 | 10/1981 | Hieber | 427/237 |
| 4,636,266 | 1/1987 | Asay | 148/6.35 |

FOREIGN PATENT DOCUMENTS

| | | |
|---|---|---|
| 2536446 | 2/1977 | Fed. Rep. of Germany . |
| 2574221 | 6/1986 | France . |
| 61-79757 | 4/1986 | Japan . |
| 61-194168 | 8/1986 | Japan . |
| 61-281864 | 12/1986 | Japan . |

*Primary Examiner*—Richard Bueker
*Attorney, Agent, or Firm*—Baker & Daniels

[57] ABSTRACT

A metal oxidation treatment apparatus to form the passivation film on the surface of the metal to be oxidized such as stainless steel or the like, comprising an oxidation furnace, a gas inlet to introduce gas into said oxidation furnace, a discharge outlet to discharge the gas from said oxidation furnace, and a heater to heat said oxidation furnace to the predetermined temperature, so that the metal to be oxidized is heated and oxidized in dry oxidation atmosphere while gas is passed in said oxidation furnace.

8 Claims, 8 Drawing Sheets

APPARATUS FOR OXIDATION TREATMENT OF METAL

TECHNICAL FIELD

The present invention relates to an apparatus for the oxidation treatment of metal, and particularly to an oxidation treatment apparatus for the passivation of metal tubular parts having a curved portion, which are to be used for ultra-high clean gas piping system or ultra-high vacuum equipment.

BACKGROUND OF THE INVENTION

In recent years, the technique for attaining ultra-high vacuum or the technique for producing ultra-high clean reduced pressure atmosphere by introducing a gas at a low flow rate into vacuum chamber is becoming increasingly important. These techniques are applied for the research of material characteristics, for the formation of various types of thin film, for the manufacture of semiconductor devices, etc. As the result, higher degree of vacuum is attained, while there is a strong demand on the reduced atmosphere, where the intermingling of impure elements and impure molecules could be reduced to utmost extent.

For example, in the manufacture of semiconductor devices, the dimensions of unit elements are being reduced year by year to attain higher integration of integrated circuit. Fervent research and development activities are carried out for the practical application of semiconductor devices having a dimension of 1 $\mu$m to submicron, or 0.5 $\mu$m or less.

Such semiconductor devices are manufactured by repeating the process for forming thin film and the etching process of the film thus formed into the specified circuit pattern. Usually, such processes are performed in ultra-high vacuum conditions or in reduced pressure atmospheres with the specified gas by placing the silicon wafers into the vacuum chamber. If the impurities are intermingled during these processes, the quality of thin film may be reduced or the precision fabrication may not be achieved. This is the reason why an ultra-high vacuum and an ultra-high clean reduced pressure atmosphere is wanted.

One of the major reasons hindering the actualization of an ultra-high vacuum and an ultra-high clean reduced pressure atmosphere has been the gas released from the surface of stainless steel widely used for the chamber of the gas pipe. Above all, the source of the worst contamination has been the moisture adsorbed on the surface, which is released under vacuum or reduced pressure atmosphere.

FIG. 9 is a graphic representation showing the relation between total leakage of the system, including the gas piping system and reaction chamber in each apparatus (the sum of gas quantity released from inner surface of the piping system and reaction chamber with the external leakage), and gas contamination. It is assumed that the original gas does not contain the impurities. The lines in the diagram indicate the results when the values are changed with gas flow rate as a parameter. Naturally, the lower the gas flow rate is, the more the impurities concentration increases as the influence of the released gas from the inner surface becomes conspicuous.

In the semiconductor manufacturing process, there is a trend to increasingly reduce the gas flow rate in order to attain a process of higher accuracy by opening and filling the holes with a high aspect ratio. For example, it is now normal to use the flow rate of several tens of cc/min. or less for the process of manufacturing ULSI of submicron order. Suppose that the flow rate is 10 cc/min. and that the total leakage of the system is $10^{-3}$ to $10^{-6}$ Torr l/sec. such as the apparatus currently in use, the purity of the gas is 1% to 10% ppm, this being far from the high clean process.

The present inventors have invented the ultra-high clean gas supply system and have succeeded in reducing the leakage from outside the system to less than $1\times10^{-11}$ Torr l/sec. which is the detection limit of the detectors presently in use. However, the concentration of the impurities in the reduce pressure atmosphere could not be reduced due to the leakage from inside the system or due to the components of the related gas from the stainless steel surface. In the case of stainless steel the minimum value of the surface released gas quantity as obtained by the surface treatment in the ultra-high vacuum technique at present is $1\times10^{-11}$ Torr l/sec. $cm^2$. Suppose that the surface area exposed to the interior of the chamber is estimated to the minimum, e.g. to 1 $m^2$, the total leakage is $1\times10^{-7}$ Torr l/sec. This means that only the gas with a purity of about 1 ppm can be obtained with a gas flow rate of 10 cc/min. The purity is doubtlessly decreased when gas flow rate is lowered further.

In order to decrease the released gas from the inner surface of the chamber to 1×10–11 Torr l/sec., i.e. to the same level as the external leakage of the total system, it is necessary to set the released gas from the surface of stainless steel to less than 1×10–15 Torr l/sec. $cm^2$. As a result, there is a strong demand for a better processing technique in order for the surface of stainless steel to have a lower gas release.

In the semiconductor manufacturing process, a wide variety of gas is used from relatively stable common gases (such as $O_2$, $N_2$, Ar, $H_2$, He) to special gases having reactivity, corrosive property and toxicity. As the material for the piping and chamber for these gases stainless steel is normally used because of its higher reactivity, corrosion resistance, high strength, easy secondary fabrication, weldability and easy polishing of its inner surface.

Stainless steel shows excellent corrosion-resistant property in a dried gas atmosphere Among the special gases, however, there are boron trichloride ($BCl_3$) or boron trifluoride ($BF_3$), which generates a high corrosive property by generating hydrochloric acid or hydrofluoric acid through hydrolysis when moisture exists in the atmosphere. Thus, stainless steel is easily corroded when moisture exists in the gas atmosphere containing $BCl_3$ or $BF_3$. Therefore, anti-corrosion processing is indispensable after surface polishing of stainless steel.

For anti-corrosion processing, there are several methods, one of which is Ni-W-P coating (clean escorting method) to coat the highly corrosion-resistant metal onto the stainless steel. There are some problems with this method because cracking and pinholes often occur and the adsorbed moisture on the inner surface or the residual solution components increase because wet type metal plating is employed. There is also another anti-corrosion processing method which is a passivation treatment to produce an oxide film onto the metal surface. Stainless steel is passivated when it is immersed in a solution containing a sufficient quantity of an oxidizer.

In this method, stainless steel is usually immersed in a nitric acid solution at a normal temperature or a little higher, thus the passivation treatment is performed. However, this method is also of a wet type, and the residues of moisture and the processing solution remain on the inner surface of the piping and the chamber. In the methods as described above, the existence of moisture adsorbed on the inner surface of the piping procedures severe damage to the stainless steel when a chlorine or fluorine type gas is introduced.

Therefore, it is very important for the ultra-high vacuum technique or in the semiconductor manufacturing process to fabricate the chamber or the gas piping system with stainless steel having a passivated film, which is not easily damaged by corrosive gas and which occludes or adsorbs less moisture.

For example, in the passivation treatment of stainless steel pipe, a passivated film having excellent degassing property is obtained when heating and oxidation are performed in a highly clean atmosphere with moisture content of less than 10 ppb.

FIG. 10 summarizes the changes of moisture contained in the purge gas when the stainless steel pipes with different internal process conditions are purged at normal temperature. In the experiment, argon gas was passed at a flow rate of 1.2 l/min. through ⅜" stainless steel pipe having a total length of 2 m, and the moisture content in argon gas at the outlet was determined by APIMS (atmospheric pressure ionization mass spectrometer).

The stainless steel pipes under test are divided into three types: (A) Stainless steel pipe with an inner surface processed by electrolytic polishing; (B) Stainless steel pipe with an inner surface processed by passivation treatment with nitric acid after electrolytic polishing; (C) Stainless steel pipe, on which the passivated film is formed by heating oxidation in a highly clean and dry atmosphere after electrolytic polishing. In FIG. 10, these are respectively represented by the curves A, B and C. The experiment was performed after leaving each of these stainless steel pipes in a clean room maintained at a relative humidity of 50% and at a temperature of 20° C. for about one week.

As is evident from the curves A and B, a large quantity of moisture was detected from the electropolished pipe (A) and the electropolished pipe having a passivation treatment with nitric acid (B). After the gas was passed for about one hour, a moisture content of 68 ppb was detected in A and 36 ppb in B. Moisture content did not decrease after 2 hours, showing 41 ppb and 27 ppb in A and B respectively. In contrast, the moisture content decreased to 7 ppb within 5 minutes after the gas was passed through the pipe (C) with the passivation film formed in a highly clean and dry atmosphere After 15 minutes, it decreased to less than the background level of 3 ppb. Thus, it was demonstrated that (C) has excellent degassing property to adsorption gas.

However, in order to attain an ultra-high clean oxidation atmosphere with a moisture content of less than 10 ppb in order to produce the stainless steel pipe similar to (C) in FIG. 10, it is essential to have high-grade condition control. This involves higher cost and lower production efficiency and is no suitable for mass production. In other words, it is impossible to attain an ultra-high clean oxidation atmosphere by the metal oxidation apparatus and metal oxidation method as conventionally employed.

Particularly, in the stainless steel pipe or the stainless steel pipe having the curved portion with a smaller inner diameter such as ¼", ⅜" and ½", gas is very likely to stagnate, and oxidation treatment is performed with the inside of the stainless steel pipe exposed to atmospheric air, resulting in contamination. This makes it impossible to form the passivation film of good quality having superb corrosion-resistant property and with lesser moisture occlusion and adsorption. Because the outer surface of stainless steel pipe is not directly related with the supply o ultra-high purity gas, the surface becomes contaminated after oxidation treatment due to roughness and dirtiness of the surface. The oxidation of the outer surface of stainless steel pipe results in the problems such as poor external appearance or the generation of particles when pipes are installed in a clean room.

Therefore, there have been strong demands on the establishment of a mass production technique for the passivation treatment for stainless steel pipe in order that the passivation film is formed to provide the inner surface with excellent corrosion-resistant property and to occlude or adsorb moisture in lesser content and that the outer surface is not oxidized.

The object of the present invention is to solve these problems by offering a metal oxidation treatment apparatus and a metal oxidation treatment method, by which the contamination caused by the released gas or impurities such as moisture from the oxidized surface of stainless steel pipe having a curved portion is reduced and the stainless steel pipe for a ultra-high vacuum and an ultra-high clean reduced pressure apparatus and for a gas supply system having an excellent corrosion-resistant property can be produced in large quantities.

Another object of this invention is to offer a metal oxidation treatment apparatus capable of self-cleaning and self-maintenance in addition to the above object.

DISCLOSURE OF THE INVENTION

The first point of this invention is to offer a metal oxidation treatment apparatus to form a passivation film on the surface of an oxidized curved metal pipe such as a stainless steel pipe having a curved portion, comprising an oxidation furnace, a gas inlet to introduce gas into said oxidation furnace, a discharge outlet to discharge the gas from said oxidation furnace, a heater to heat said oxidation furnace to the predetermined temperature, and a holder serving also as a connection joint to fix the tubular oxidized metal having the curved portion (hereinafter referred a the oxidized curved metal pipe), wherein said inlet is arranged to come into contact with one end of said oxidized curved metal pipe, said discharge outlet is arranged to come into contact with the other end of said oxidized curved metal pipe, and said oxidized curved metal pipe is heated and oxidized in a dry and oxidizing atmosphere while the gas is passed into said oxidized curved metal pipe.

The second point of this invention is to offer a metal oxidation treatment apparatus of the first point, comprising an inlet different from said inlet and to introduce the purge gas into said oxidation furnace which is arranged to not come into contact with said oxidized curved metal pipe, and a discharge outlet different from said discharge outlet and to discharge the gas from said oxidation furnace which is arranged to not come into contact with the other and of said oxidized curved metal pipe, wherein the oxidation of the outer surface of said oxidized curved metal pipe is prevented.

The third point of this invention is to offer a metal oxidation treatment apparatus of either one of the first or the second point wherein, when said oxidized curved metal pipe is arranged or fixed in said oxidation furnace, said oxidation furnace is opened from said discharge outlet or said discharge outlet and the other outlet, a gas line for purge is connected to introduce the purge gas to said inlet or said inlet and the other inlet when opened, and said oxidized curved metal pipe is prevented from the exposure to atmospheric air when it is arranged or fixed in said oxidation furnace.

The fourth point of this invention is to offer a metal oxidation treatment apparatus of either one of the first or the third point, wherein a gas line is furnished to switch over the purge gas and the oxidation atmosphere gas to the inlet of said gas, a means is provided to permanently discharge the gas in the line not supplying gas to said oxidation furnace, of the purge gas line and the oxidation atmosphere gas line of said gas line, and the oxidation atmosphere is maintained at highly clean condition.

The fifth point of this invention is to offer a metal oxidation treatment apparatus of either one of the first or the fourth point, wherein a heater is provided on the oxidation atmosphere gas line and the purge gas line connected with said inlet or with said inlet and said other inlet, and the temperature of the gas to be supplied to said oxidation furnace is heated up to the temperature of the oxidation atmosphere.

In the present invention, stress is given to the efficient exclusion of the impurities such as moisture from the oxidation atmosphere when the oxidation furnace is closed, and the new gas is permanently introduced into the oxidation furnace and the gas is discharge from inside the oxidation furnace.

Specifically, when the oxidation treatment is conducted in the interior of the oxidized curved metal pipe such as stainless steel pipe with a smaller inner diameter and with the curved portion, where gas is difficult to flow, the gas inlet and outlet are arranged in such a manner that they come into contact with both ends of the pipe.

Thus, gas is introduced on one hand, while the oxidation atmosphere gas is forcibly passed through the curved pipe by permanently discharging the gas on the other hand. The impurities such as moisture separated from the surface of the oxidized curved metal pipe in the oxidation furnace is discharged from the oxidation furnace, and the oxidized curved metal pipe is heated and oxidized in a dry oxidation atmosphere. This makes it possible to decrease the moisture content in the oxidation atmosphere to lower than the desired value (e.g. less than 10 ppb) and to form a good passivation film on the surface of the oxidized metal.

To prevent the oxidation of the outer surface of the curved pipe, it is possible to form the passivation film only on the inner surface of the curved pipe without oxidizing the outer surface thereof by passing the inert gas to the outside of the curved pipe in the oxidation furnace. To obtain such an effect more positively, it is advised to increase the pressure of inert gas outside the curved pipe to higher than the pressure of the oxidation atmosphere gas inside the curved pipe. This suppresses the flow of the gas from inside to outside of the curved pipe and prevents the leaking of the oxidation atmosphere gas to the outside the curved pipe.

Giving attention to the contamination before the oxidation furnace is closed, it is attempted in this invention to prevent the intermingling of the impurities such as moisture in the oxidation furnace when the oxidation furnace is opened. When the oxidation furnace is opened and the oxidized curved metal pipe is arranged or fixed in the oxidation furnace, it is very effective, for preventing the exposure of the interior of the oxidation furnace and the oxidized curved metal pipe to the atmospheric air containing the impurities, to provide the opening on the side of the discharge outlet of the oxidation furnace, to introduce the purge gas permanently from the inlet and to build up the gas flow, which passes from inside the oxidation furnace to the opening. This makes it possible to prevent the atmospheric air from entering into the opened oxidation furnace and to reduce the time required for decreasing the moisture content in the oxidation atmosphere to lower than the desired value (e.g. less than 10 ppb).

It is also important for obtaining a better effect to provide the supply system for the introduced gas with the function of permanently supplying high purity gas. Particularly, in case two gas lines such as the purge gas line and the oxidation atmosphere gas line are connected with the inlet, contamination often occurs within the system by impurities such as moisture when switched over from purge gas to oxidation atmosphere gas or from oxidation atmosphere gas to purge gas. This is mainly caused by contamination with the released gas, mostly the moisture from the inner wall of the pipe when the supply gas (e.g. $O_2$ as oxidation atmosphere gas) is stopped.

When the metal is to be heated and oxidized in the oxidation atmosphere, after the oxidized curved metal pipe is arranged or fixed in the oxidation furnace, the baking and the purge are performed for the oxidation furnace and the oxidized curved metal pipe. Baking is performed at the same temperature as the oxidation temperature until the moisture content in the discharge gas becomes sufficiently low (e.g. less than 10 ppb). After the baking and the purge by the purge gas are completed, the gas to be supplied into the oxidized curved metal pipe is switched over to the oxidation atmosphere gas (such as $O_2$) to start the oxidation treatment (passivation treatment). If the impurities, mostly moisture, are intermingled in the system during the switch-over of gas, heating and oxidation are performed in an atmosphere containing moisture. Therefore, it is necessary to decrease the temperature inside the oxidation furnace to room temperature to purge the oxidation atmosphere gas when oxidation is not proceeding within the oxidation furnace and to perform the oxidation by increasing the temperature of oxidation furnace after the contaminants are completely removed. However, a time period as long as 12–24 hours is required for the treatment by decreasing temperature, and it is desirable to have the system, which is capable to reduce the contamination within the system as practical as possible when gas is switched over in order to shorten the oxidation time.

For this reason, a system is proposed, in which the inert gas supply line and the oxidation atmosphere gas supply line are switched over by a mono-block valve, formed by integrating four valves to minimize dead space, and, of the inert gas supply line and the oxidation atmosphere gas supply line, the supply line not supplying gas to oxidation furnace is always discharged, thereby preventing the stagnation of ga and supplying ultra-high pure gas. This system makes it possible to maintain ultra-high purity of the supplied ga in stable and satisfactory conditions, to switch over the gas very easily and to eliminate the intermingling and the influence of the impurities during switch-over even when the oxidation furnace is at high temperature. Specifically, this can be maintained if the moisture content of the atmosphere in the oxidation furnace is set to lower than the desired value (e.g. less than 10 ppb) the gas can be switched over without decreasing the temperature of oxidation furnace or performing long-time purge with ga in the oxidation furnace.

Further, by installing the heater in the gas supply system, it is possible to heat the introduced gas to the temperature equal to that of the oxidation atmosphere in the oxidation furnace, to maintain the temperature of the oxidation atmosphere, to perform positive temperature control in the oxidation furnace and to improve the oxidation efficiency.

Thus, it is possible to create an even passivation film on the surface of the oxidized curved metal pipe, to reduce the impurities caused by the released gas from the surface, and to provide a metal oxidation apparatus and a metal oxidation method to offer the parts for a ultra-high vacuum and an ultra-high clean reduced pressure apparatus and gas supply piping system having excellent anti-corrosion property against the reactants and corrosive gases.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Figure 8:
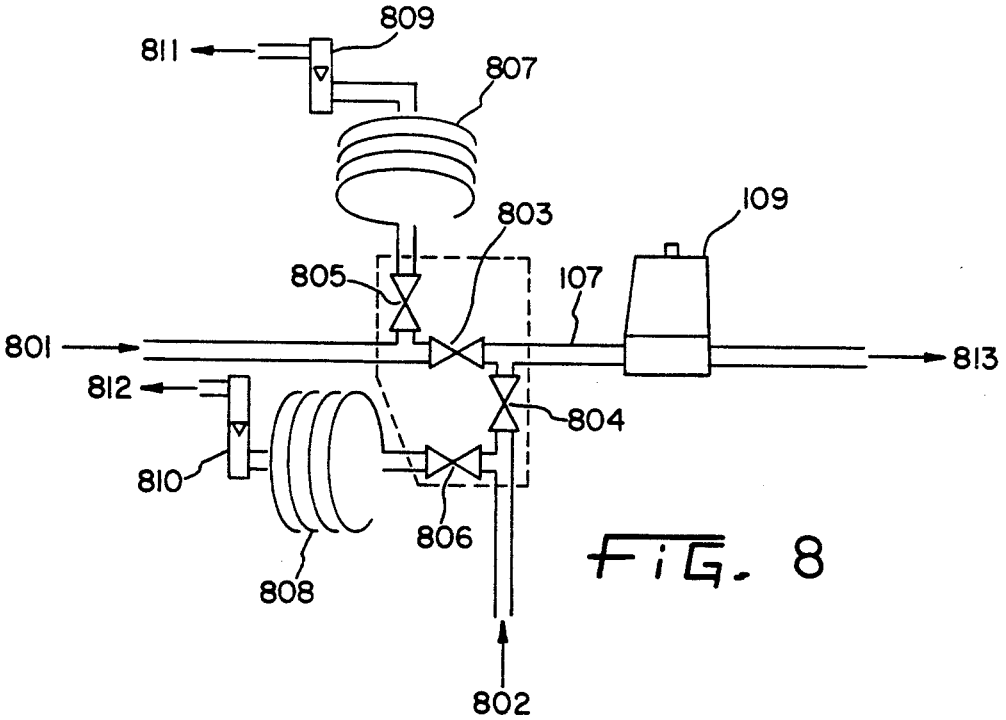
Figure 9:
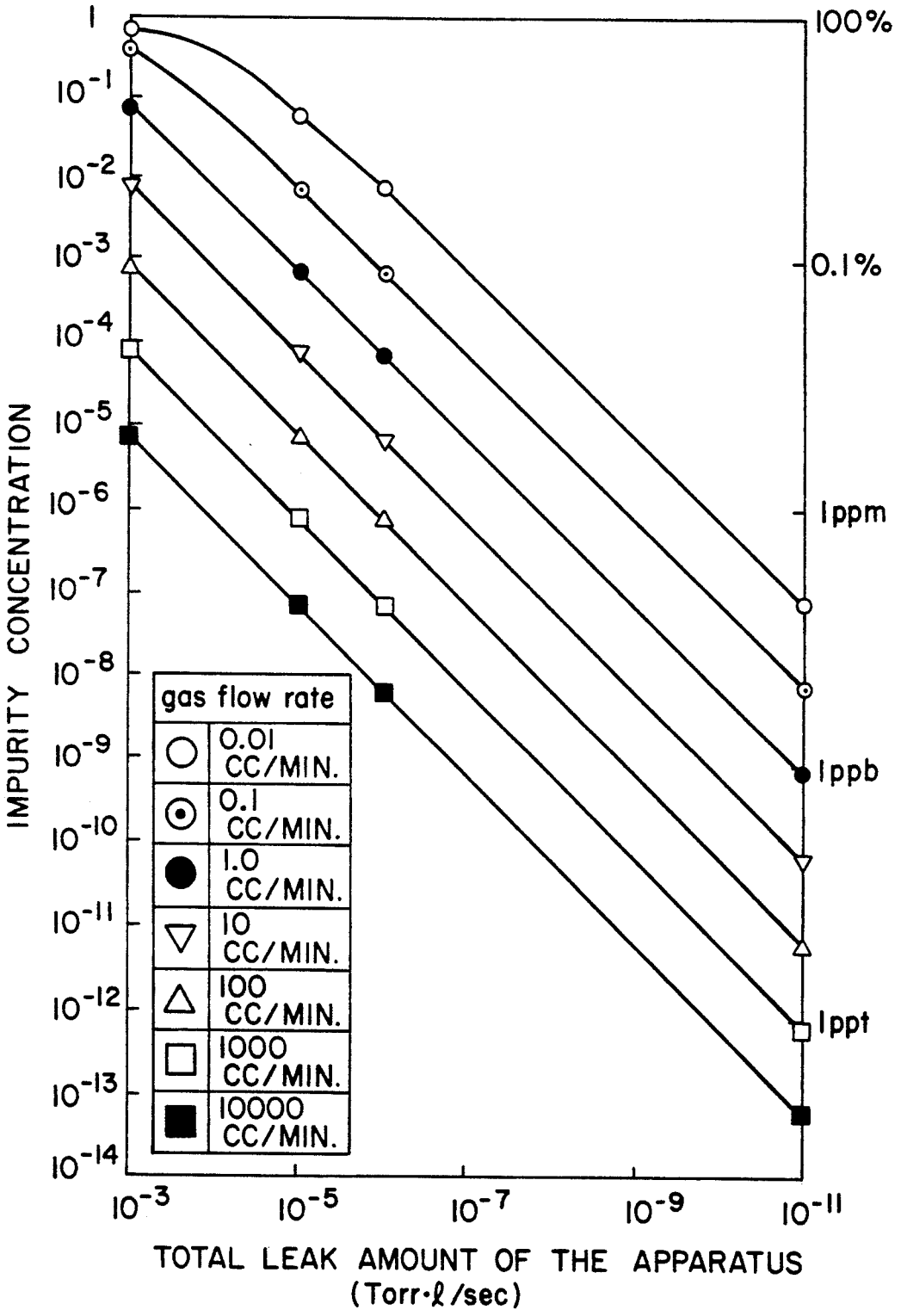
Figure 10:
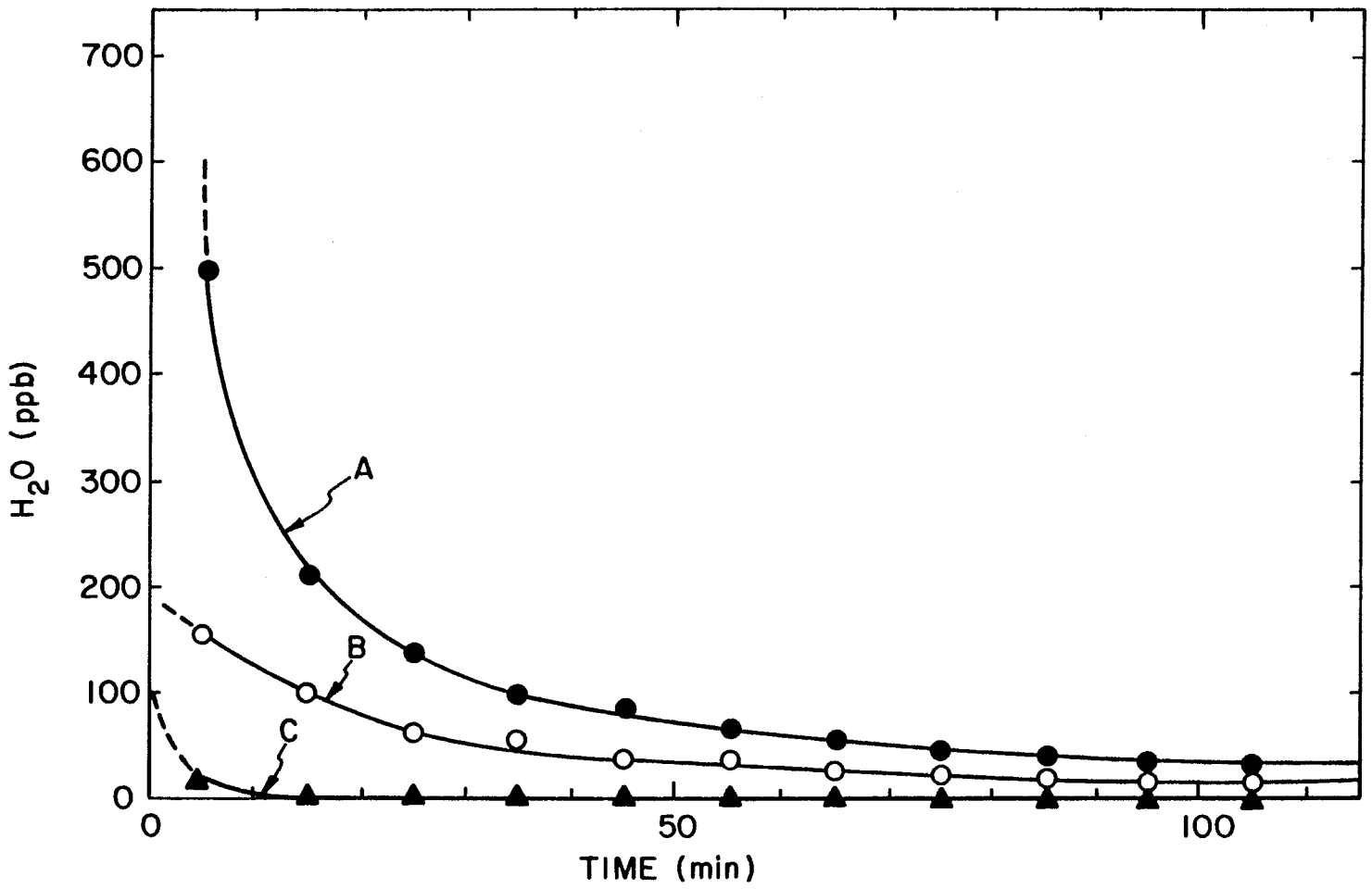

FIG. *7a* is a top plan view of the nonlinear pipe holder according to the present invention;

FIG. *7b* is a lateral sectional view of the holder of FIG. *7a*;

FIG. 8 is a schematic representation of the piping system for preventing system contamination during gas switch over of the present invention;

FIG. 9 is a graph showing the total leak amounts of the present apparatus to the impurity concentration thereof; and FIG. 10 is a graph showing the summarization of changes of moisture contained in the purged gas when stainless steel pipes with different internal process conditions are purged at normal temperature.

Corresponding reference characters indicate corresponding parts throughout the several views. The exemplification set out herein illustrates one preferred embodiment of the invention, in one form, and such exemplification is not to be construed as limiting the scope of the invention in any manner.

DESCRIPTION OF THE PREFERRED EMBODIMENT

In the following, an embodiment of the present invention will be described in connection with the drawings.

Figure 1:
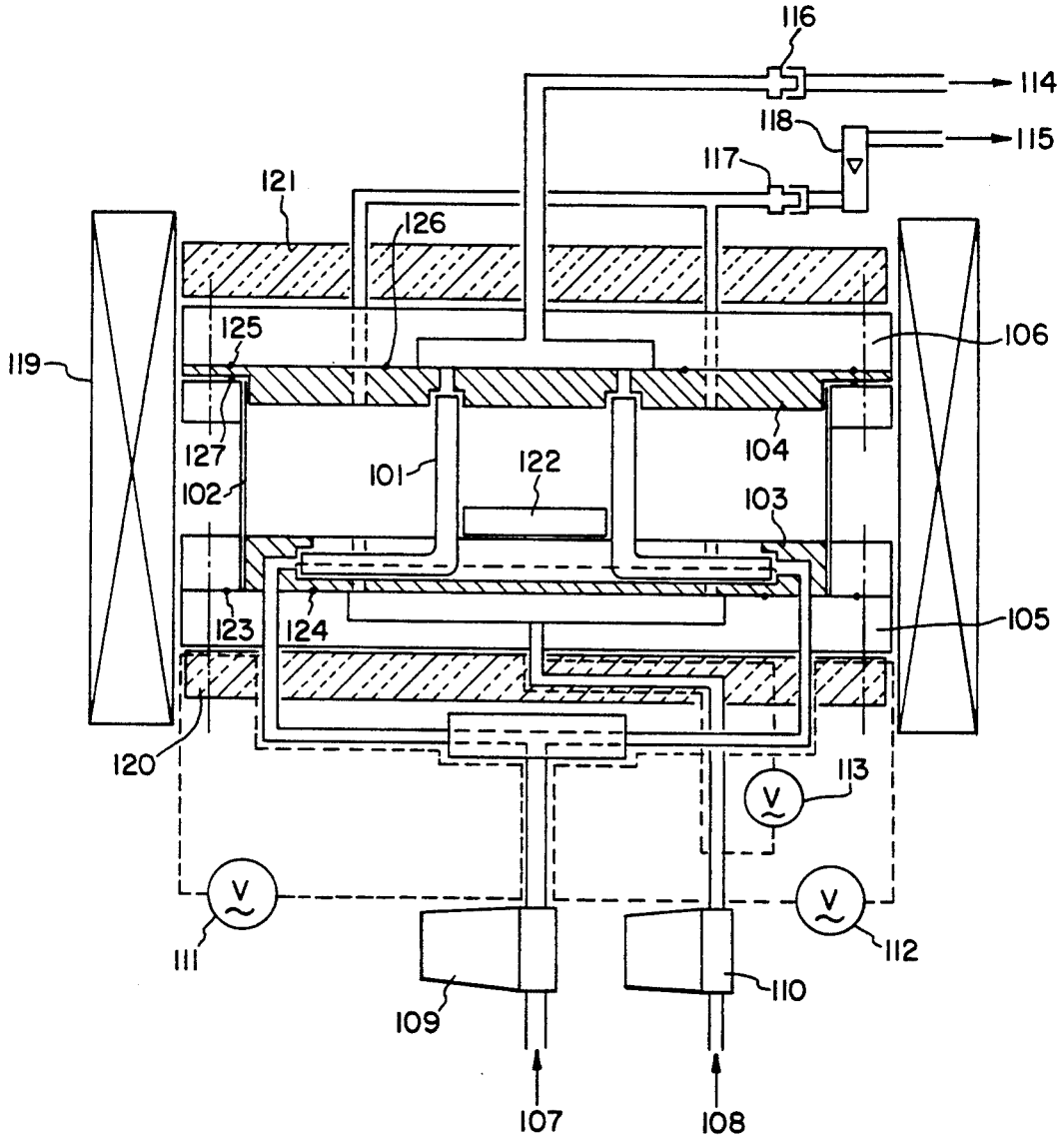
FIG. 1 is a sectional view of an embodiment for the oxidation treatment of a nonlinear pipe according to the present invention.

FIG. 1 is a schematical drawing of an embodiment for the oxidation treatment of an elbow according to the invention.

In FIG. 1, 101 represents an elbow, i.e. an oxidized metal pipe having the curved portion, which is usually a pipe of SUS 316L of $\frac{1}{4}''$, 154 " or $\frac{1}{2}''$ in diameter with electropolished inner surface. Normally, 20–100 pieces of this pipe in regular size are used. Naturally, the pipe may have a diameter other than above. 102 shows an oxidation furnace. This may be made of quartz pipe, but it is desirable to fabricate it with stainless steel with inner surface processed by electropolishing and passivation treatment if consideration is given to thermal expansion and gas-tightness of the elbow 101 when heating oxidation is performed. 103 and 104 are the holders, concurrently used as gaskets, to give airtightness to the elbow 101 to pass the gas. To provide airtightness when it is inserted into the elbow and heated, it is desirable to fabricate them with a material (such as nickel alloy) having a lower thermal expansion coefficient than stainless steel, with easier internal treatment and with less influence from the released gas. Also, the holder 103 is provided with a guide to fix the elbow in upward position.

Figure 7A:
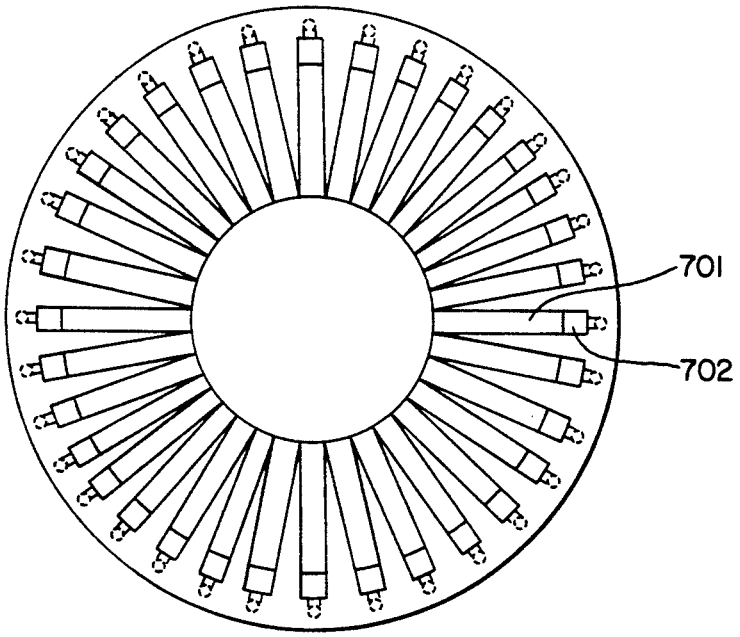
Figure 7B:
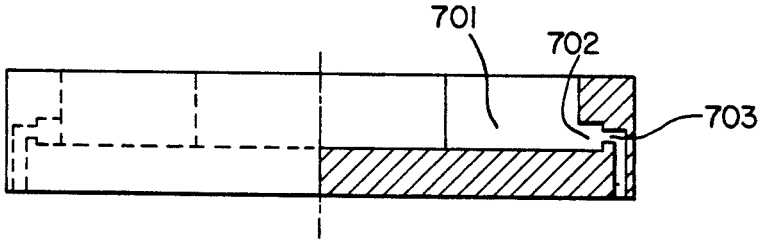

A schematical drawing of the holder 103 is shown in FIG. 7 (*a*) and (*b*). FIG. 7 (*a*) is a view of the holder 103 from above, and a holder to accommodate 34 elbows is given in this example. 701 is a grooved guide to fix the elbow, and 702 is an elbow insert. FIG. 7 (*b*) is a view of the holder 103 from lateral side. Its left half is a perspective side view, and the right half is a cross-sectional view along the centerline. One end of the elbows is inserted into the elbow insert 702 and a gas inlet 703 is provided to come into contact with one end of the elbow.

In the following, description will be given in connection with FIG. 1. 105 and 106 are flanges and are shaped in such a manner that the gas flows evenly in relation to each elbow. 107 is a gas inlet pipe for supplying a purge gas (such as Ar) and an oxidation atmosphere gas (such as $O_2$) into each of the elbows. 108 is an inlet pipe for a purge gas to supply an inert gas (such as Ar) to prevent the contamination through oxidation of the outer surface of the elbow by providing an inert gas to the outer surface of the elbow. 114 and 115 are the discharge lines of the gas flowing inside and outside each of the elbows. The gas inlet pipes 107 and 108 and the discharge lines 114 and 115 are made of SUS 316L pipes with an electropolished inner surface with a pipe diameter of $\frac{3}{8}''$, $\frac{1}{2}''$, etc. The opening from the gas inlet pipe 107 into the oxidation furnace 102 serves as the inlet, and the opening from the gas inlet pipe 108 into the oxidation furnace 102 is the other inlet. The opening from the discharge line 114 into the oxidation furnace 102 is the discharge inlet, and the opening from the discharge line 115 into the oxidation furnace 102 is the other discharge outlet. 118 represents a float type flowmeter, and 109 and 110 are the mass flow controllers, which regulate the flow rate of the gas flowing in the oxidation furnace 102 and calculate the gas quantity flowing from 109, 110 and 118 to the elbow 101. Of course, a mass flow controller may be used as 118, and the float type flowmeters with needle valve may be used as 109 and 110, but it is desirable to use the mass flow controllers for 109 and 110 in order to keep the atmosphere in the oxidation furnace 102 in a highly clean condition. Although the flowmeter 118 is furnished on the discharge line 115, it may be furnished on the discharge line 114 or on both of the discharge lines 114 and 115. 116 and 117 are MCG (metal C-ring type) joints to separate the discharge lines 114 and 115 when the flange 106 is removed. It is preferable to use MCG joints in order to exclude external leakage and particles. 119 is a heater, and it is advisable to use a two-piece type electric furnace with longitudinal wiring from the viewpoints of maneuverability and the equalization of the oxidation treatment temperature. 120 and 121 are the heat insulating material to prevent heat radiation in the longitudinal direction of the electric furnace and to equalize the temperature within the oxidation furnace 102 as practical as possible. 111, 112 and 113 are the heaters to heat the gas entering the oxidation furnace 102 up to the oxidation temperature. 122 is a guide to fix the position of the elbow 101 so that the end of the elbow 101 is easily inserted into the holder 104. 123, 124, 125, 126 and 127 are the packings to seal the oxidation furnace 102 with the flanges 105 and 106, and it is desirable to use a material having an elasticity at more than 500° C. (such as nickel alloy) from the viewpoint of the heating and oxidation temperature.

Next, the functions and operating procedure of this apparatus will be described in connection with the drawings.

Figure 2:
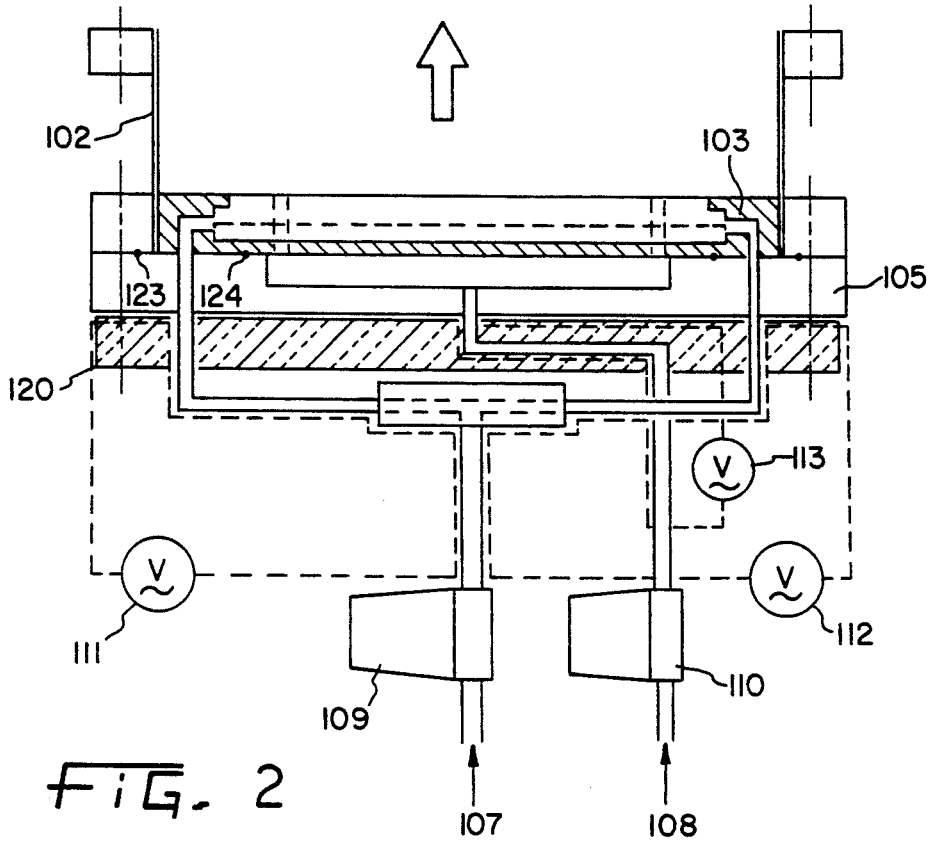
FIG. 2 is a sectional view of the lower holder assembly of the present oxidation treatment apparatus in the condition where the oxidation furnace is open and the non-linear pipe is not yet accommodated.

FIG. 2 shows the condition where the oxidation furnace 102 is opened and the elbow is not yet accommodated. In the passivation treatment technique, it is necessary to open it in an atmosphere as clean as possible because the cleanness of the atmosphere has a strong influence on the thickness and quality of the passivation film. For this reason, the condition of FIG. 2 is maintained in as short time as possible to minimize the contamination inside the oxidation furnace 102 by atmosphere air.

In this embodiment, the side having the flange 106 is opened. The side to be opened may be the side having the flange 105, whereas it is most preferable from the viewpoint of contamination due to atmospheric air as described above to continuously pass the purge gas (such a Ar) from the side of 105 while the flange to be opened is provided on the side of 106 and to prevent the intermingling of the atmospheric components into the oxidation furnace 102.

Figure 3:
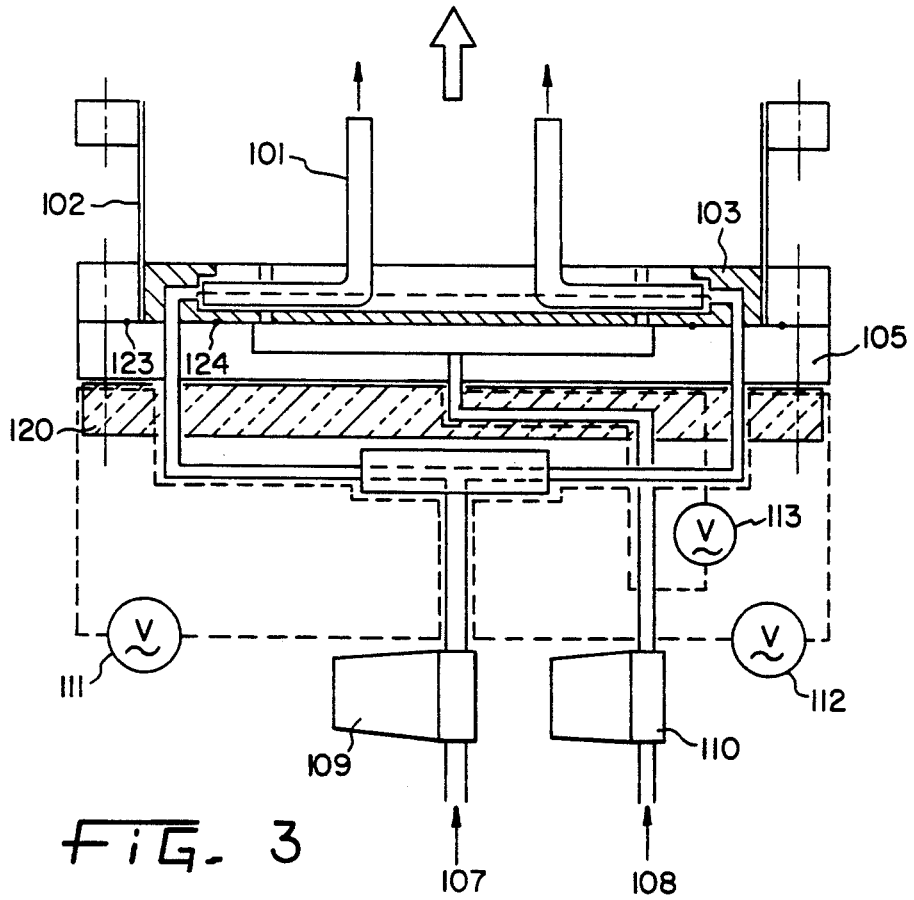
FIG. 3 is a sectional view of the holder apparatus of FIG. 1 wherein the nonlinear pipes are accommodated after the condition of FIG. 2 therein according to the present invention.

FIG. 3 shows the condition where the elbow 101 is accommodated in the oxidation furnace 102 after the condition of FIG. 2. The elbow 101 is inserted along the guide (the guide 701 as shown in FIG. 7 (*a*)) of the holder 103, and it is set into the elbow insert (the elbow insert 702 as shown in FIG. 7 (*a*) and (*b*)) of the holder 103. In this case, the intermingling of the atmospheric components should be as minimized as practically possible in a manner similar to FIG. 2. Also, to prevent the generation of the particles, gas should be passed from the gas inlet pipes 107 and 108. Further, a gas guide 122 is placed at the center and fixed.

Figure 4:
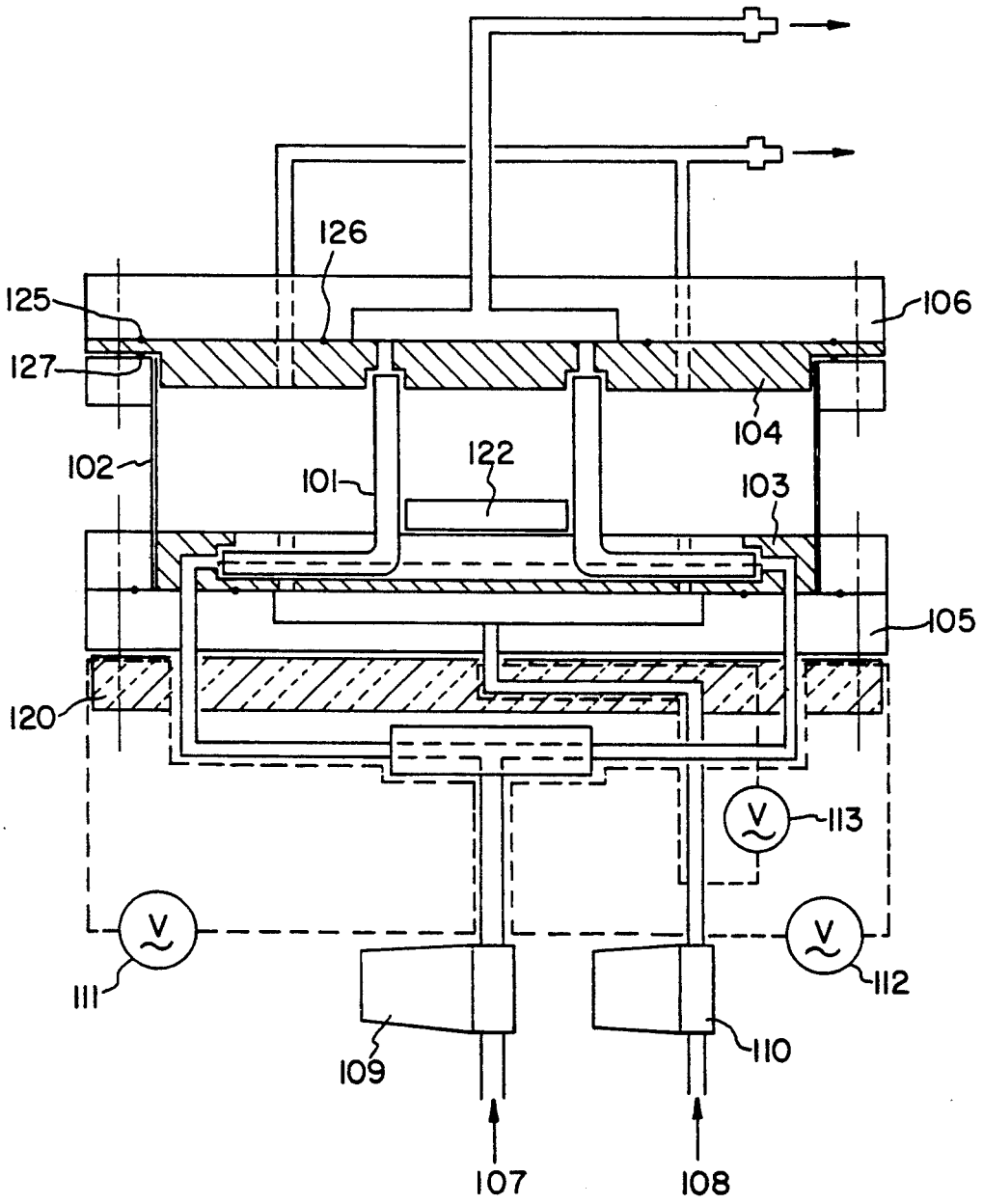
FIG. 4 is a sectional view of the upper and lower holders for the nonlinear pipe after the condition of FIG. 3 according to the present invention.

FIG. 4 gives the condition, where, after the condition of FIG. 3, the holder 104 and the flange 106 are mounted on the oxidation furnace 102, where the elbow 101 is set.

Figure 5:
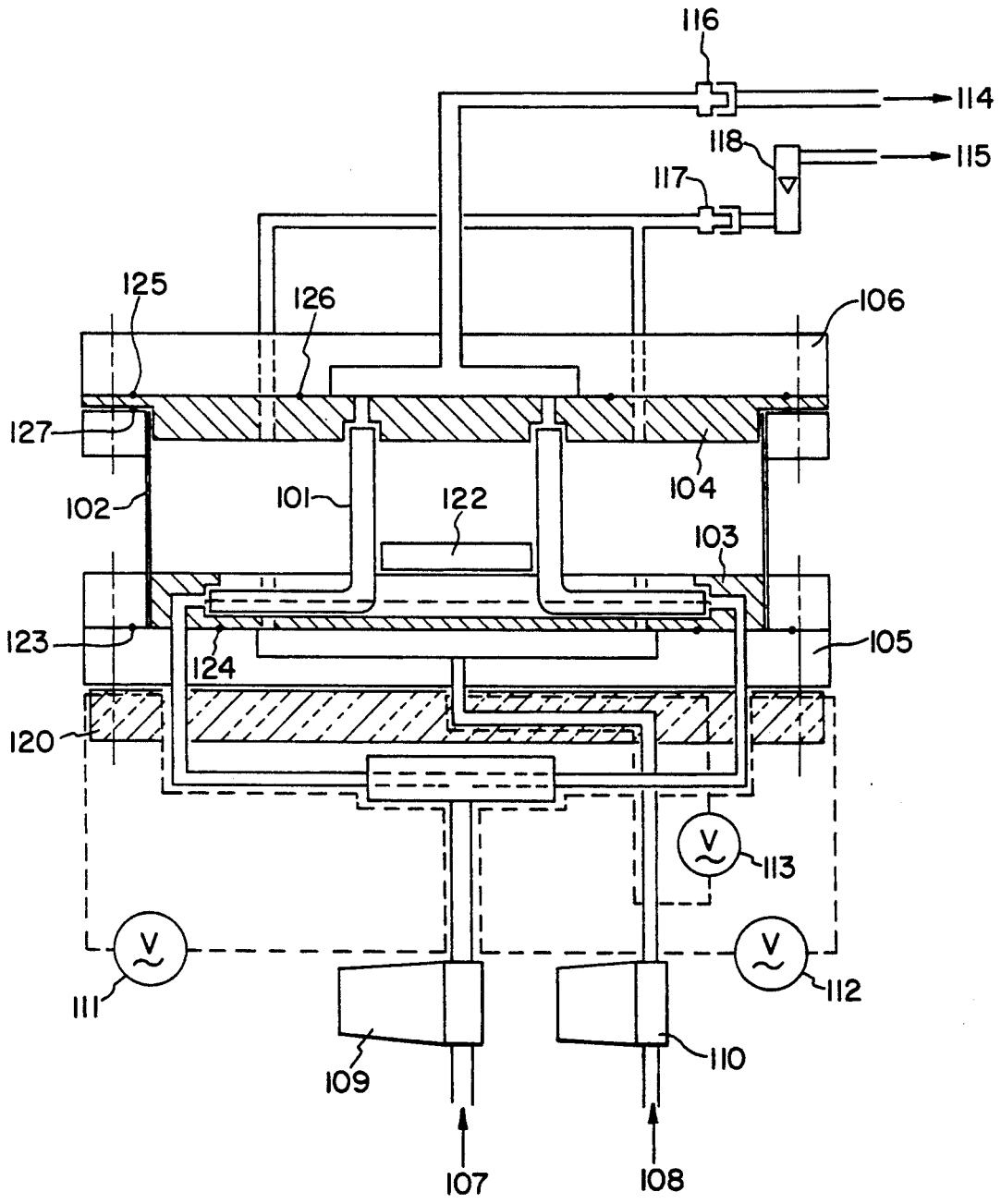
FIG. 5 is a sectional view of the embodiment of FIG. 4 wherein the discharge lines are connected thereto.

FIG. 5 shows the condition, where, after the condition of FIG. 4, the discharge lines 114 and 115 are connected with the joints 116 and 117 respectively. Under this condition, the purge gas (such as Ar) is passed into the elbow 101 and the oxidation furnace 102, and the atmosphere inside the oxidation furnace 102 contaminated by atmospheric air is replaced by an inert gas atmosphere. The flow rate of the purge gas naturally differs according to the number of the elbows processable at one time and to the size of oxidation furnace 102. For example, purging is performed with a large quantity of gas for 2–4 hours at flow rate of 2–10 m/sec. to eliminate the contaminants, mostly moisture, inside the oxidation furnace 102.

Figure 6:
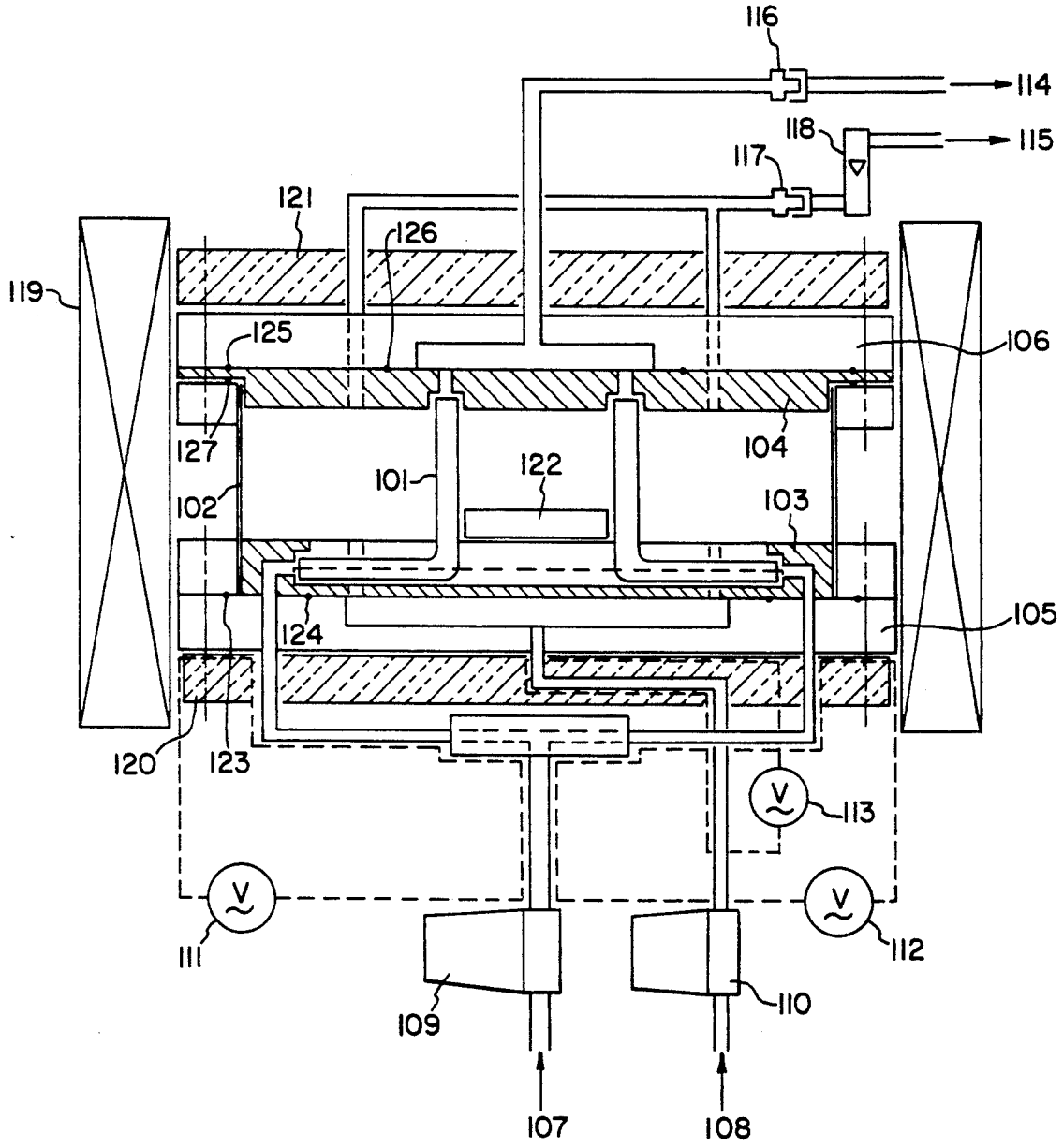
FIG. 6 is a sectional view of the present oxidation treatment apparatus according to the present invention wherein the heater and heat insulating material are set.

FIG. 6 shows the condition where, after the condition of FIG. 5, the heater 119 and heat insulating material 121 are set. Under this condition, baking and purge of the oxidation furnace 102 and the elbow 101 are performed. Baking is performed at the same temperature as oxidation temperature (e.g. 400°–500° C.) until the moisture content of the gas at the outlet is reduced to less than 5 ppb. In this case, the heaters 111, 112 and 113 of the gas inlet pipe are also heated simultaneously, and the temperature of the gas introduced into oxidation furnace 102 is set to the oxidation temperature (e.g. 400°–500° C.) in order to prevent the temperature decrease inside the oxidation furnace 102 due to the introduction of gas. After baking and purge by the purge gas are completed, the gas supplied into the elbow 101 is switched over to the oxidation atmosphere gas (such as $O_2$), and oxidation (passivation treatment) is started.

During the switch-over of gas, contaminants, mostly moisture, enters the system. For this reason, it is necessary to decrease the temperature in the oxidation furnace 102 to the room temperature, to switch over the gas from the purge gas to the oxidation atmosphere gas (such as $O_2$) and to perform oxidation by increasing the temperature of oxidation furnace 102 after purging the oxidation atmosphere gas and completely removing the contaminants while oxidation reaction is still not advance in the oxidation furnace 102.

However, a time period as long as 12–24 hours is required for decreasing the temperature. Therefore, it is necessary to reduce the oxidation time by providing the piping system to minimize the contamination of the system during gas switch-over and by switching over the gas while the oxidation furnace 102 is at a high temperature.

The contamination of the system, mostly by moisture, during the gas switch-over from the purge gas to the oxidation atmosphere gas or from the oxidation atmosphere gas to the purge gas is caused by the contamination by the released gas, mostly moisture, from the inner wall of the pipe because the supplied gas (such as $O_2$) is stagnated there. Consequently, it is desirable to set up a system where the oxidation atmosphere gas and the purge gas can be always purged and to reduce the contamination in the system during gas switch-over.

FIG. 8 shows an example of the piping system to prevent system contamination during gas switch-over. 107 and 109 correspond to the mass flow controller and gas supply pipe as shown in FIG. 1. 801 shows a supply line of oxidation atmosphere gas (such as $O_2$) and 802 a supply line of the purge gas (such as Ar). The material differs according to the number of stainless steel pipes to be oxidized or to the size of the oxidation furnace 102. It is usually made of SUS316L pipe of ⅜" or ½" with an electropolished inner surface. 803, 804, 805 and 806 represent stop valves that are mono-block valves, in which four valves are integrated to minimize the dead space. 807 and 808 are the spiral pipes to prevent the intermingling due to reverse diffusion of atmospheric components from the discharge outlet, and 809 and 910 are float type flowmeters with needle valves. Naturally, the float type flowmeter with a separated needle valve or a mass flow controller may be used as 809 or 810. 811 and 812 are the discharge lines, where the gas is discharged after adequate discharge treatment. 813 is an atmosphere gas supply line for supplying the gas to oxidation furnace 102 shown in FIG. 1.

Next, description will be given on the operation of the piping system of FIG. 8

When purging is performed inside the oxidation furnace, the valves 803 and 806 are closed and 804 is opened, and the purge gas is supplied from 802 through the gas inlet pipe 107 and the mass flow controller 109 to the gas supply line 813. In this case, the valve 805 is opened to purge the oxidation atmosphere gas from the gas supply line 801 through the spiral pipe 807 and the float type flowmeter with needle valve 809 to the discharge line 811. When purging in the oxidation furnace is completed, the valves 804 and 805 are closed and 803 is opened, and oxidation atmosphere gas is supplied to the atmosphere gas supply line 813. In this case, the valve 806 is opened, and the purge gas is purged into the discharge line 812. The contamination in the system is caused mostly by moisture when the switch-over is performed from the purge gas to the oxidation atmosphere gas or from the oxidation atmosphere gas to the purge gas. This contamination is mainly caused by the contamination of the gas to be supplied (such as $O_2$) with the released gas, mostly moisture, from inner wall of the pipe because the gas is stagnated. Therefore, it is desirable to provide a system which can permanently purge the oxidation atmosphere gas and the purge gas in order to minimize the contamination of the system even when the gas is switched over.

Also, when oxidation atmosphere gas is supplied into oxidation furnace 102 in FIG. 6, it is desirable not to release the oxidation atmosphere gas out of the holders 103 and 104 by decreasing the supply pressure of the oxidation atmosphere gas (for example $O_2$ supplied from the gas supply piping line 118) flowing inside the pipe to lower than the pressure of the inert gas (for example Ar supplied from the gas supply piping line for purge 119) flowing outside the elbow 101 by 0.1 to 0.3 kg/cm$^2$, to prevent the oxidation and contamination of the outer surface of elbow 101. However, if there is no need to protect the outer surface of the elbow from oxidation or contamination, it is naturally unnecessary to give differential pressure to the gases flowing inside and outside the elbow and to provide inert atmosphere outside the elbow.

When the moisture content in the gas discharged from the outlet was measured in this embodiment, a stabilized value of less than 10 ppb was obtained during oxidation treatment. Particularly, the time period for attaining a value of less than 10 ppb could be reduced in the equipment configuration of FIG. 7. In the piping system of FIG. 8, a value of less than 10 ppb could be maintained even during gas switch-over.

Further, after the stainless steel pipe of ⅜" with total length of 2 m as obtained by the present embodiment was left for about one week in a clean room maintained at relative humidity of 50% and at a temperature of 20° C., argon gas was passed through at flow rate of 1.2 l/min., and the moisture content in argon gas at the outlet was measured by APIMS (atmospheric pressure ionization mass spectrometer). As shown by C in the graph of FIG. 10, the value dropped to 7 ppb within 5 minutes after gas was passed and to less than the background level of 3 ppb after 15 minutes. This reveals that the elbow obtained by the embodiment of this invention has an excellent degassing property to the adsorbed gas and that the heating oxidation was performed in ultra-high clean atmosphere containing moisture of less than 10 ppb.

As described above, the embodiment according to the invention can provide ultra-high clean oxidation atmosphere with moisture content of less than 10 ppb, which the conventional metal oxidation apparatus and metal oxidation method could not perform and this is done at low cost and with better production efficiency.

In the embodiment above, description was given to the apparatus of FIG. 1 for the passivation treatment of the elbow of stainless steel pipe, whereas it is obvious that the invention is applicable not only to the passivation treatment of elbow but also to the treatment of the metals with different material and shape, e.g. the pipes with the curved portion, valves, etc. of Ni, Al, etc. or to the passivation treatment of the parts of highly clean reduced pressure apparatus. The position, the number, and the angle of the curved portion may be selected as desired and the gas inlet and the discharge outlet can be furnished at the appropriate position depending upon the shape of the metal pipes to be oxidized. Also, the apparatus of this embodiment is shown with the oxidation furnace 102 of vertical type to facilitate the positioning of the elbow for the oxidation treatment, while it may be of horizontal type.

The following effects can be obtained by this invention:

1. The invention makes it possible to efficiently eliminate the moisture from the oxidation atmosphere, to perform the heating oxidation for the oxidized metal such as a narrow elbow and the like in an ultra-high and dry oxidation atmosphere containing very few impurities such as moisture, and to form the passivation film with less released gas containing moisture on the surface of the oxidized metal in an easier and efficient manner.

2. In addition to the effects offered by (1) above, it is possible to form the passivation film only on an inner surface of the tubular oxidized metal having the curved portion such as an elbow and to prevent the oxidation of outer surface. This prevents the roughening and the contamination of outer surface after the oxidation treatment and eliminates the generation of particles when the pipe is installed in a clean room.

3. In addition to the effects offered by (1) and (2) above, the invention makes it possible to efficiently prevent the contamination by moisture from atmospheric air when tubular oxidized metal having the curved portion is installed or fixed in the oxidation furnace, to shorten the time until the ultrahigh clean and dry oxidation atmosphere is attained, and to form the passivation film in more efficient and satisfactory manner.

4. In addition to the effects offered by (1) to (3) above, the invention makes it possible to perfectly prevent the contamination of the system, mostly from moisture, when the switch-over takes place from the purge ga to the oxidation atmosphere gas or from the oxidation atmosphere gas to the purge gas, and to maintain the ultra-high clean atmosphere at all times, even when the gas is switched over. Therefore, it is possible not only to form the passivation film in satisfactory manner but also to simplify the operation and to eliminate the temperature decrease process during the gas switch-over. Further, it is possible to shorten the time required for the process, and to achieve extensive low cost production by saving energy because no re-heating of the oxidation furnace is required.

5. In addition to the effects offered by (1) to (4) above, the gas is supplied by heating it to that of the oxidation atmosphere. This makes it possible to maintain the oxidation temperature at constant level and to facilitate the control of the processing condition and to improve the oxidation treatment efficiency.

As described in (1) to (5) above, the invention makes it possible to actualize mass production of the metal parts such as elbow and the like of stainless steel having the passivation film with very few gas release and having excellent anticorrosive property. With the elbow and the like thus obtained, it is now possible to provide the system, which can supply ultra-high purity gas to the process equipment within short time, in an easier manner and at low cost.

We claim:

1. A metal oxidation treatment apparatus for forming a passivation film on an inner surface of a non-linear metal pipe, the apparatus comprising: an oxidation furnace, a first gas inlet for introducing a gas into said oxidation furnace, a first discharge outlet for discharging gas from said oxidation furnace, a heater for heating said oxidation furnace to a predetermined temperature, and a pair of holders for holding a said pipe, at least one of said pair of holders having a groove therein to hold said pipe, said pair of holders including a pipe insert portion, and a passage which communicates with said first gas inlet and said pipe insert portion, whereby said inner surface of a said non-linear metal pipe may be oxidized in a dry and oxidizing atmosphere as the gas is passed from said first gas inlet into a said non-linear metal pipe through said passage and said pipe insert portion.

2. A metal oxidation treatment apparatus as set forth in claim 1, further comprising a gas line connected to said first inlet, and a heater provided on the gas line wherein the temperature of the gas to be supplied to said oxidation furnace is heated up to the temperature of the oxidation atmosphere.

3. A metal oxidation treatment apparatus as set forth in claim 1 further comprising; a second gas inlet for introducing a purge gas into said oxidation furnace, said second gas inlet is arranged such that the purge gas does not come into contact with one end of a said non-linear metal pipe, and a second discharge outlet for discharging the purge gas from said oxidation furnace, said second discharge outlet is arranged such that the purge gas does not come into contact with another end of a said non-linear metal pipe, wherein the oxidation of an outer surface of a said non-linear metal pipe is prevented by the purge gas flow into said oxidation furnace.

4. A metal oxidation treatment apparatus as set forth in claim 3, further comprising a first gas line for supplying purge gas wherein when a said non-linear metal pipe is held in said oxidation furnace and said oxidation furnace is opened from at least one of said first discharge outlet and said second outlet, said first gas line is connected to introduce the purge gas to at least one of said first inlet and said second inlet when opened, whereby said non-linear metal pipe is prevented from exposure to atmospheric air when it is held in said oxidation furnace.

5. A metal oxidation treatment apparatus as set forth in claim 1, further comprising a first gas line for supplying purge gas wherein, when a said oxidized curved metal pipe is held in said oxidation furnace and said oxidation furnace is opened from said first discharge outlet said first gas line is connected to introduce the purge gas to said first gas inlet whereby a said oxidized curved metal pipe is prevented from exposure to atmospheric air when it is held in said oxidation furnace.

6. A metal oxidation treatment apparatus as set forth in claim 5, further comprising a second gas line for supplying purge gas and oxidation atmosphere gas to said second gas inlet, and a means for permanently discharging the gas in the first gas line, whereby the oxidation atmosphere is maintained at a highly clean condition.

7. A metal oxidation treatment apparatus as set forth in claim 1, further comprising a gas line for supplying purge gas and oxidation atmosphere gas to said first gas inlet, and a means for permanently discharging the gas in the gas line wherein the oxidation atmosphere is maintained at a highly clean condition.

8. A metal oxidation treatment apparatus as set forth in claim 7, further comprising a heater provided on at least one of said first gas line and said second gas line, wherein the temperature of the gas to be supplied to said oxidation furnace is heated up to the temperature of the oxidation atmosphere.

* * * * *